United States Patent [19]

King

[11] 4,035,818

[45] July 12, 1977

[54] COLOR PRINT OR FILM PROCESSOR

[75] Inventor: Roger A. King, Minneapolis, Minn.

[73] Assignee: The King Concept Corporation, Minneapolis, Minn.

[21] Appl. No.: 531,535

[22] Filed: Dec. 11, 1974

[51] Int. Cl.[2] ..... G03D 3/08

[52] U.S. Cl. ..... 354/323; 222/450; 354/331

[58] Field of Search ..... 354/299, 310, 312, 323, 354/324, 325, 327, 328, 329, 330, 331; 222/148, 450

[56] References Cited

U.S. PATENT DOCUMENTS

| | | | |
|---|---|---|---|
| 2,811,286 | 10/1957 | Bauerlein | 222/450 X |
| 3,589,264 | 6/1971 | Jensen | 354/323 X |
| 3,703,860 | 11/1972 | Wilkinson | 354/329 X |
| 3,705,544 | 12/1972 | Ratowsky | 354/329 X |
| 3,792,487 | 2/1974 | Peres | 354/299 |
| 3,840,214 | 10/1974 | Merz | 354/330 X |
| 3,846,818 | 11/1974 | Merz | 354/324 |

FOREIGN PATENT DOCUMENTS

| | | | |
|---|---|---|---|
| 789,828 | 7/1968 | Canada | 354/323 |

*Primary Examiner*—Fred L. Braun
*Attorney, Agent, or Firm*—Merchant, Gould, Smith, Edell, Welter & Schmidt

[57] ABSTRACT

Automatic photographic developing apparatus in which the photographic material to be developed is placed in a cylindrical drum. The drum is laid on its side on a set of rollers, one of which causes it to rotate. A plurality of containers for various photographic liquids are provided with valve arrangements by which their contents are delivered either in total or in measured increments to the rotating drum. The drum is mounted in a cradle so that it can be tilted to drain liquids from it. Specific details are given of the drum, its driving and cradle tilting components, the liquid dispensing and metering components, and the program control apparatus whereby the photographic materials may be treated with selected solutions in selected orders for predetermined intervals.

3 Claims, 18 Drawing Figures

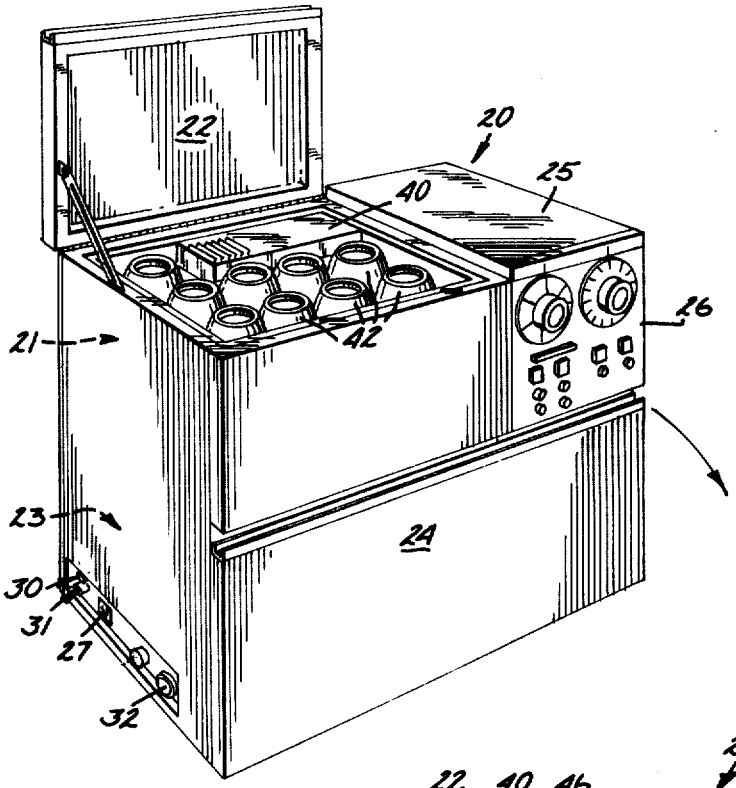
FIG. 1
FIG. 2
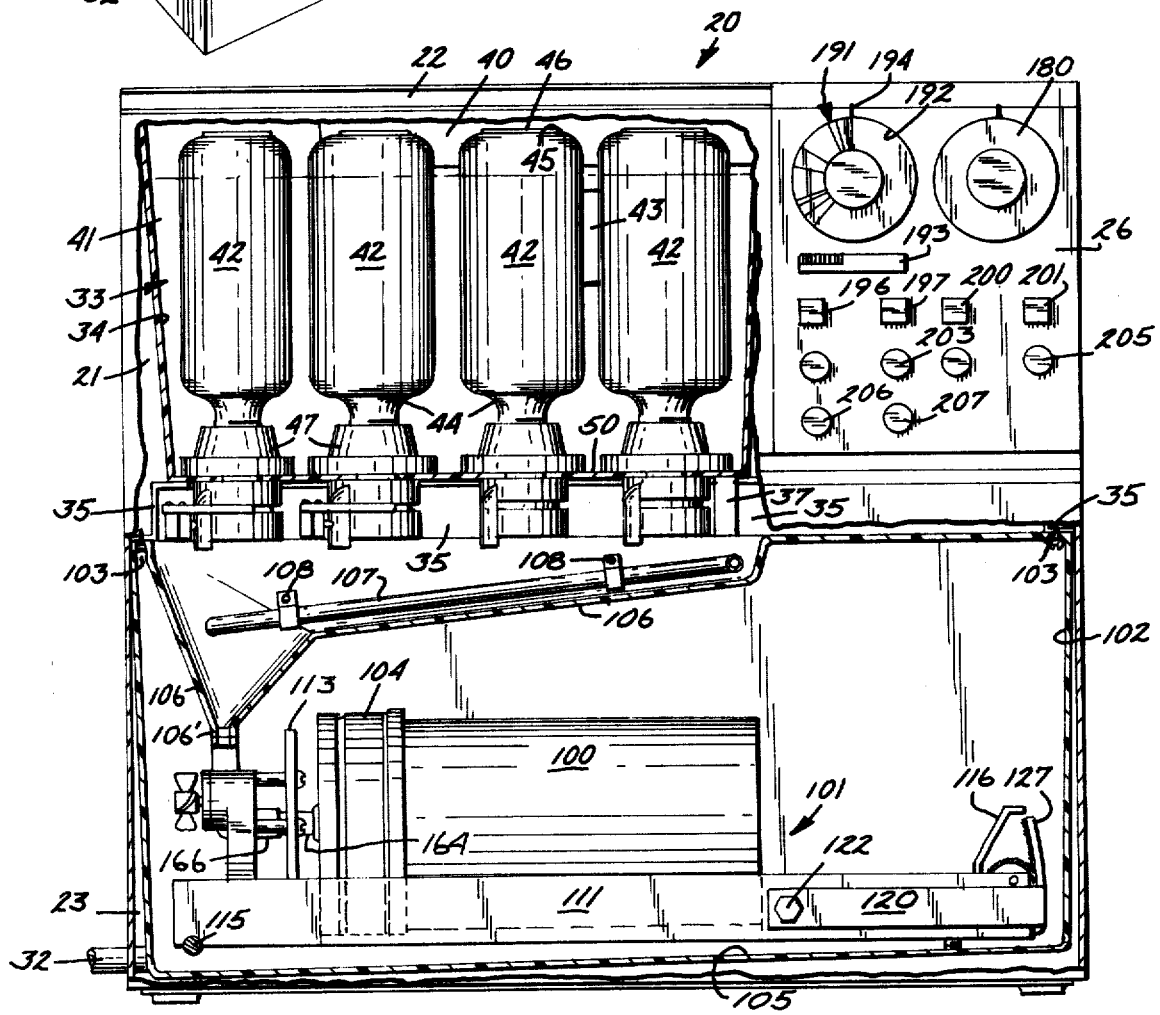

FIG. 6
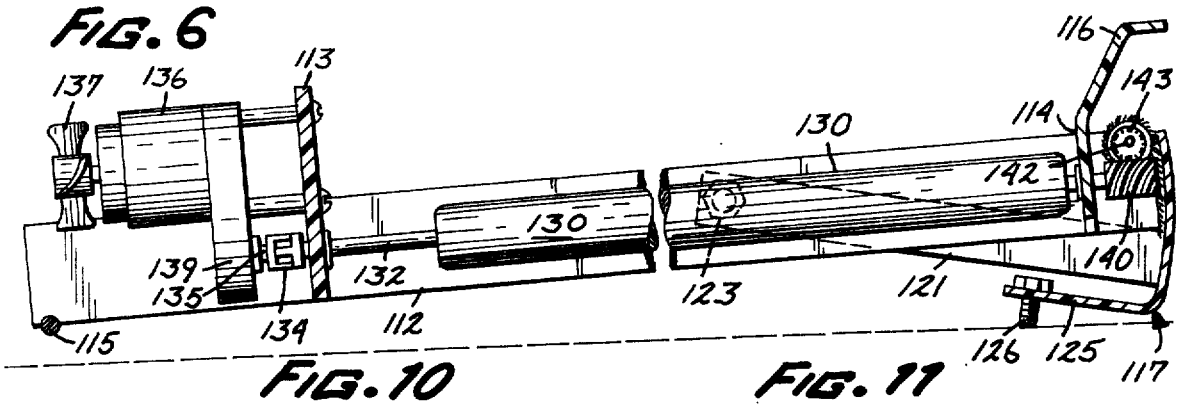
FIG. 10
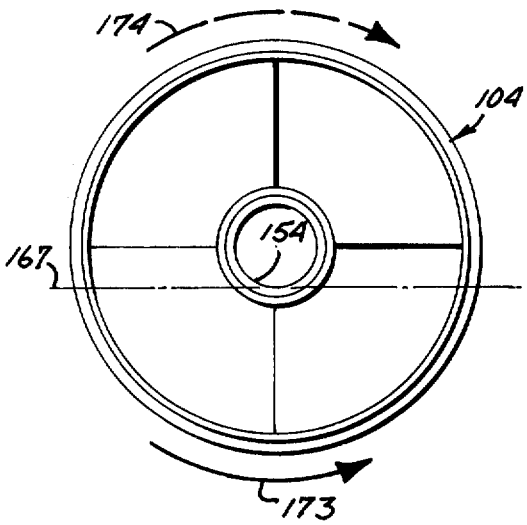
FIG. 11
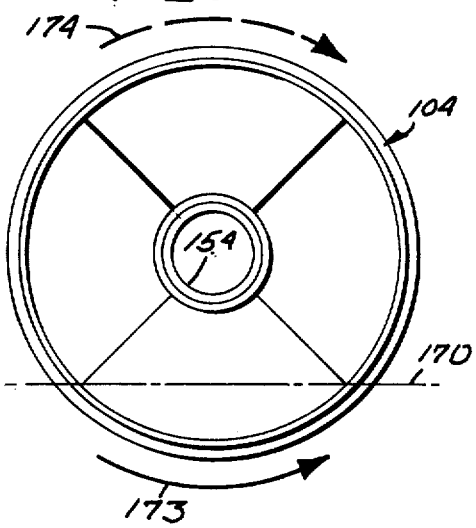
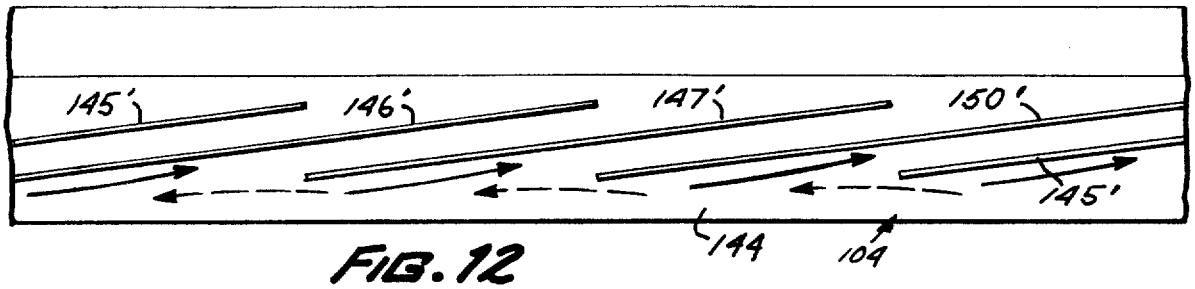
FIG. 12
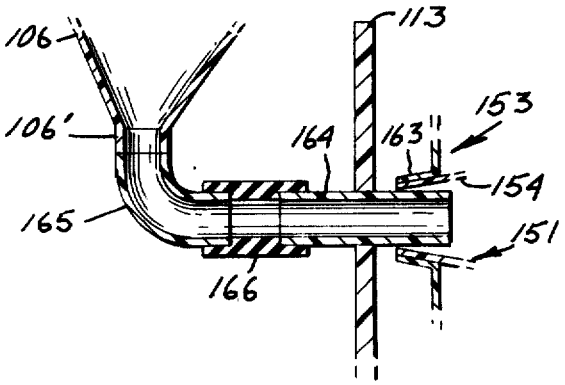
FIG. 13

FIG. 7
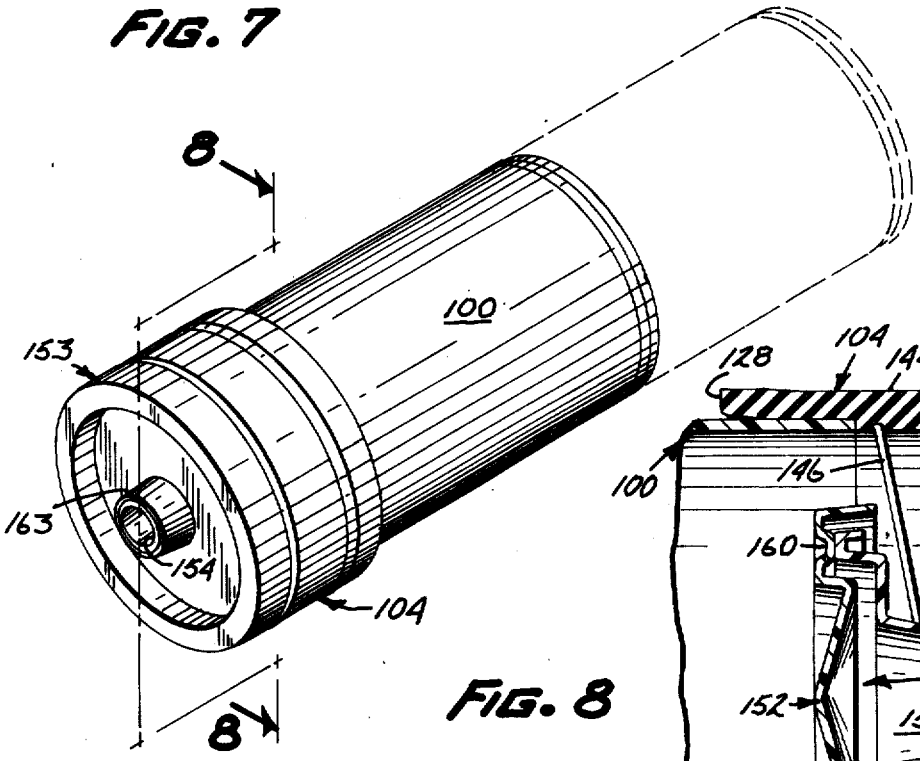
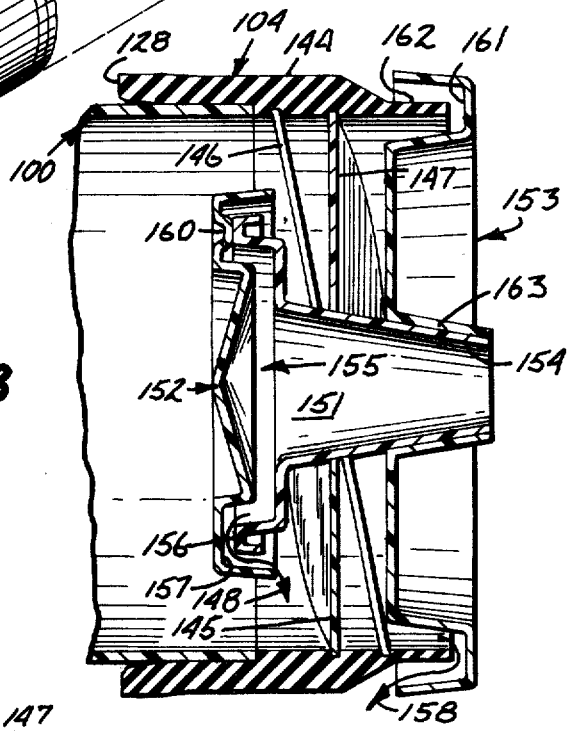
FIG. 8
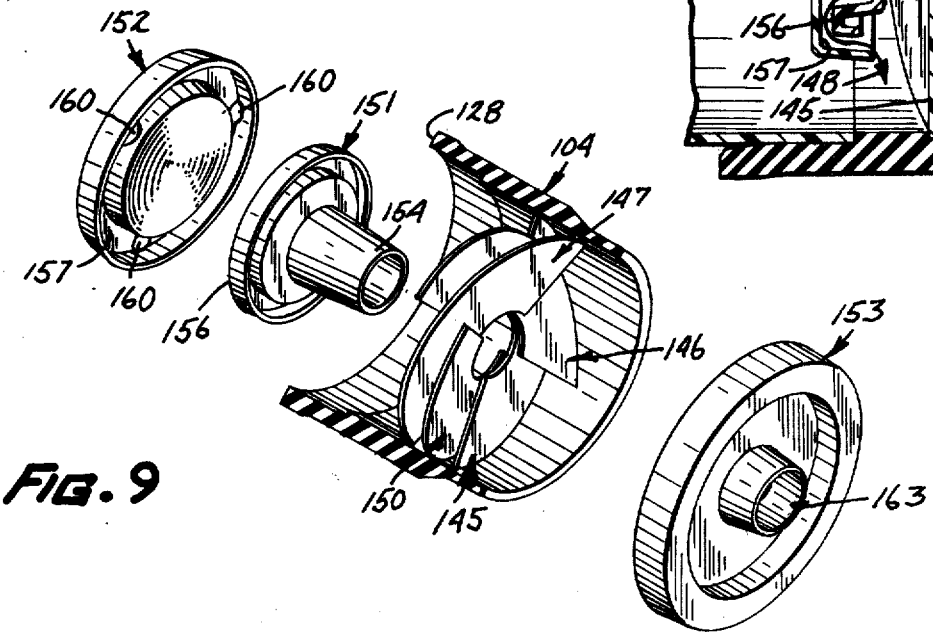
FIG. 9

COLOR PRINT OR FILM PROCESSOR

This invention relates to the field of photography and comprises an improvement in the art of processing silver halide materials such as films and printing papers, primarily those associated with color photography.

BACKGROUND OF THE DISCLOSURE

Photographic processing can be carried out at a very simple technological level, where a single operator working with acquired skill in a dark room manipulates the film or paper, passing it through trays containing the necessary chemicals for necessary time intervals, and relying on dexterity to complete the procedures before solution temperatures depart unacceptably from the appropriate values. This is the procedure of the typical photographic amateur, and highly successful results can be obtained by competent amateurs who have to contend with no press of time for commercial practicality.

At the other extreme, photgraphic processing can be carried out on a wholesale scale, where wholly automatic machines handle enormous masses of photographic material with speed and competence, where dark room operation and human operator skill are held to a minimum, and where large volumes of chemicals are dispensed and utilized with continuous control of composition, temperature and time intervals to give a result that is uniformly successful, if not uniformly superior. Naturally such machines are large, expensive and intricate, and hence are practical only for the processor on a commercial scale.

Attempts have been made to produce machines useful to the serious professional photographer and yet within his reach financially. Such machines have in the past required a great deal of manual operation, and a great deal of operation under dark room conditions, and have often resulted in unsatisfactory results by reason of contamination of one liquid with small quantities of liquid from a previous process.

BRIEF DESCRIPTION OF THE INVENTION

My invention comprises a photographic processing machine which is relatively modest in size and cost, which is automatic and yet programmable to process any silver halide material having known processing requirements, which requires a minimum interval of dark room operation in its loading phase only, and which is minimal in its likelihood of interchemical contamination because of improved arrangements for cleaning and rinsing, as well as because of the absence of any significant amount of commonly used liquid conducting conduit.

My invention provides a new and improved photographic processing machine which is convenient in use, modest in size and cost, and universal in applicability, which is programmable to process any silver halide material having requirements which are known, which is automatic after loading, and yet uses modest quantities of chemicals and avoids the danger of contamination of one solution by traces of previously used solution, and which includes drums of different sizes to contain the material being processed, so that dark room operation can be obviated after loading, and so that economy of chemical usage is maintained.

More specific features of the invention are that its chemical storage containers are easily replaced for washing without disturbing the system as a whole, that the discharge from the containers may be total or by metered amounts, and that no chemical is left standing anywhere in the system except inside of storage containers themselves.

Another specific feature of the invention is a new and improved arrangement for filling and emptying a processing drum.

Another specific feature of the invention is a new and improved valve assembly for liquid dispensing.

Another specific feature of the invention is a new and improved mixing arrangement for providing wash water at a desired temperature.

Another specific feature of the invention is a new and improved arrangement for retaining liquid in or withdrawing liquid from a rotating cylindrical processing drum.

Another specific feature of the invention is a new and improved arrangement for selectively transmitting or not transmitting power depending on the direction of rotation of a shaft.

Another specific feature of the invention is a novel arrangement for distributing liquid from any of a plurality of containers to a rotating drum, without danger of contamination by a previously used liquid.

Various other advantages and features of novelty which characterize my invention are pointed out with particularity in the claims annexed hereto and forming a part hereof. However, for a better understanding of the invention, it advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWINGS

In the drawing

FIG. 1 is a perspective view of my machine;

FIG. 2 is a front elevation, portions being broken away and shown in section;

FIG. 6 is a view like FIG. 5 but showing parts in an alternative position;

FIG. 7 is a perspective view of a drum used in my invention;

FIG. 8 is a section of the drum cap taken along the line 8—8 of FIG. 7.

FIG. 9 is an exploded view of the drum cap, parts being shown in section;

FIGS. 10 and 11 are views in end elevation of the vane structure in the drum cap, shown in two different positions;

FIG. 12 is a development view showing the construction of the cap;

FIG. 13 is a fragmentary detail sectional view of a portion of the invention;

DESCRIPTION OF THE PREFERRED EMBODIMENT

Figure 3:
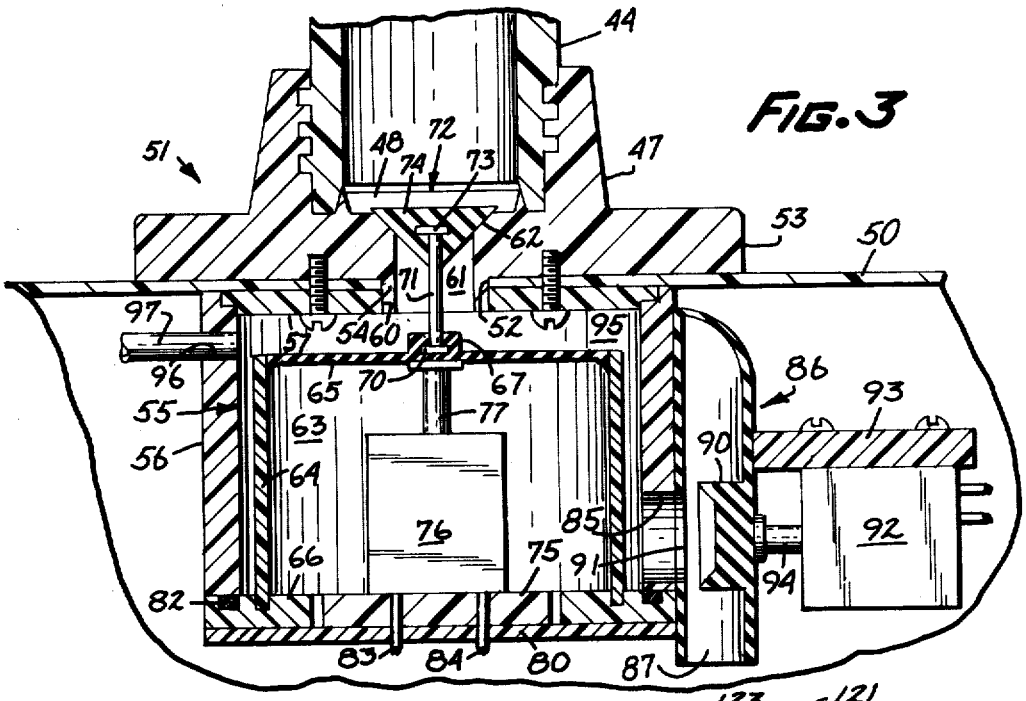
FIG. 3 is a sectional view of a valve assembly used in my invention.
Figure 4:
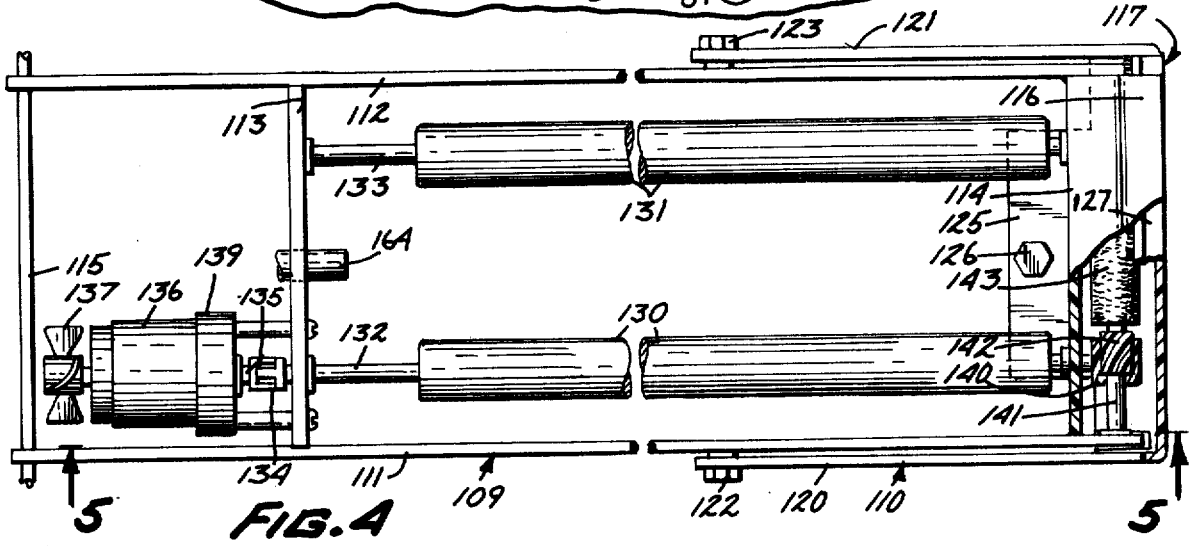
FIG. 4 is a plan view of a cradle used in my invention, parts being broken away.

The automatic developing apparatus according to my invention is contained in a cabinet 20 which provides a water bath enclosure 21 having a top cover 22, a processing enclosure 23 having a front cover 24, and a control enclosure 25 having a front panel 26. The cabinet has an electrical inlet connection 27, hot and cold water connections 30 and 31, and a drain connection 32.

A water bath 33 having a shell 34 is supported in enclosure 21 on a suitable ledge 35, secured to the walls of cabinet 20, and a cross bracket 37 connected thereto. Water bath 33 includes suitable control apparatus 40 for agitating and monitoring the level of water 41 contained in shell 34 and maintaining its temperature at a desired value, usually above ambient. Nearly submerged in the water in bath 33 are a plurality of containers 42 for processing liquids of which the temperature is to be maintained constant, as well as a heat exchanger 43, the latter being conveniently located beneath control apparatus 40. Suitable means not shown are provided for supplying water to and drawing water from the bath 33 as desired.

Containers 42 are of clear or brown polypropylene and have a generally bottle-like configuration. Each has a screw threaded neck 44 at one end and a large opening 45 at the other end. Covers 46 fit loosely in the large ends of the containers to protect the contents from contamination. Containers 42 are screwed tightly against sealing ridges 48 in sockets 47 located in the bottom 50 of shell 34. These sockets form parts of a plurality of valve assemblies 51 best shown in FIG. 3. The bottom 50 of shell 34 is provided with a plurality of apertures 52. The base 53 of each socket 47 is generally flat, but has a central hub 54 projecting downwardly to be received in one of the apertures 52, and project below the bottom 50, of shell 34.

Associated with each socket 47 is a valve casing 55 comprising a rigid cylinder 56 sealed at its upper end to a disc 57 which is centrally apertured at 60 to fit over hub 54. Hub 54 in turn is centrally bored to provide a passage 61 terminating upwardly in a valve seat 62.

Reentrant within casing 55 is a solenoid chamber 63 comprising a rigid cylinder 64 closed at its top by a flexible diaphragm 65, and sealed at its lower end to a rigid ring 66. The center of diaphragm 65 is enlarged to form a boss 67 and receive in snap fashion a first head 70 of the stem 71 of a poppet valve 72. Stem 71 has a second head 73 which is received in snap fashion in the poppet 74 of valve 72, which is of flexible material like diaphragm 65. In the normal state of valve 72, poppet 74 engages seat 62, thus preventing the passage of any liquid from container 42.

Mounted on a pedestal 75 is a solenoid 76 having a plunger 77 which normally engages the lower surface of diaphragm 65 under boss 67. Pedestal 75 is carried on a disc 80 concentric with the outside of ring 66, and suitable fastening means pass through disc 80 and ring 66 and secure both to the lower end of cylinder 56, and O-ring 82 being provided to make the seal liquid tight. Electrical connections 83 and 84 pass through disc 80 and pedestal 75 to solenoid 76.

At the bottom of cylinder 56 is a lateral opening 85. Cemented to the outside of the cylinder at this location is a flexible boot 86 having a discharge opening 87. The wall of boot 86 opposite opening 85 is enlarged to form a stopper 90, and the boot is apertured at 91 in line with aperture 85. A solenoid 92 is mounted on a bracket 93 carried by cylinder 56, and has a plunger 94 resting against the outside of boot 86 at the location of stopper 90.

Energization of solenoid 76 lifts poppet 74 to allow fluid to pass from container 42 into a metering chamber 95, and energization of solenoid 92 presses stopper 90 inward to close the apertures 85 and 91. A metering chamber is defined by disc 57, cylinder 56, disc 66, cylinder 64, and diaphragm 65, and includes the volume of apertures 85 and 91 and the volume of passage 61 below poppet 73. If only solenoid 76 is energized, liquids flows from container 42 past valve 72, through the metering chamber, through apertures 85 and 90 to boot 86 and out at aperture 87. Air to replace the fluid in container 42 enters past the loose cap 46.

If both solenoids are energized, liquid passes into the metering chamber but is retained there by stopper 90, so that the chamber fills, air from the chamber passing upward through passage 61 as liquid passes down. After a determinable interval the chamber has been filled: solenoid 76 may now be de-energized and a metered volume of liquid stands in the chamber, to be discharged by de-energization of solenoid 92. It is thus possible to provide either continuous flow or metered flow from the containers. Metered flow is desirable when exact volumes are needed, since it avoids the necessity of providing accurately timed short operating periods for the valving.

Some of the valve assemblies, where metering is not necessary, omit elements 86–94. This simplified structure is used for liquids which are always to be discharged by the container-full, where it is only necessary to energize solenoid 76 for an interval longer than the emptying time of the container.

Near the upper portion of each cylinder 56 there is an opening 96 for the admission of wash water through a conduit 97. This conduit is normally closed at its other end so that substantially no liquid from container 42 passes into it during metering operation of the valve assembly.

The processing performed by my apparatus is carried out in a drum 100 rotatably carried on a tilting cradle 101 in a cradle housing 102 located in processing enclosure 23 and suspended from ledge 35 by suitable members 103. Drum 100 has an open end which may be closed by a cap 104: it is sized to receive either negative film or photographic paper, the former on suitable spreader reels and the latter resting against the inner surface of the drum with its emulsion directed inwardly. It is understood that the unprocessed photographic material must be inserted into the drum in the absence of actinic light: preferably the inner surface of the drum of dry for this procedure.

The bottom 105 of housing 102 slopes gently to drain 32. The sides and back of the housing are closed, and the front has an access opening through which drum 100 with cap 104 may be inserted. The top of housing 102 is recessed downwardly into the housing in the area under water bath 33 to form a funneling tray 106 which tapers to a nozzle 106'. It will be clear that any liquid discharged through any of the boot apertures 87 falls on tray 106 and is directed to nozzle 106'. A spray tube 107 of horseshoe configuration is secured to the upper rim of tray 106 by suitable clips 108.

Cradle 101 comprises a closed frame 109 and a U-frame 110. Frame 109 has longitudinal members 111 and 112 and cross members 113 and 114, and is pivotally connected to housing 102 by a rod 115: cross member 114 may be extended upwardly and outwardly to form a splash guard 116. U-frame 110 has a cross member 117 and a pair of longitudinal members 120 and 121 pivoted near their ends to members 111 and 112 respectively as by bolts 122 and 123. Member 117 has a first portion 125 extending horizontally and carrying a leveling screw 126, and a second portion 127 extending generally upwardly, and cylindrically concave, the radius of the concavity being the distance from that surface to the centers of pivot bolts 122 and 123.

A pair of parallel rollers 130 and 131 are mounted for rotation in cross members 113 and 114 and are spaced to receive drum 100 when lying on its side. The rollers are long enough to support drums of several lengths, which are held in a desired axial position with respect to the roller by contact of the edge 128 of cap 104 with the ends of rollers 130 and 131, since these rollers do not extend the full lengths of their shafts 132 and 133.

Shaft 132 is extended beyond cross member 113 and is connected by a flexible coupling 134 to the shaft 135 of an electric motor 136 carried by member 113 and having a cooling fan 137 and a reduction gear box 139. At its other end shaft 132 is extended beyond cross member 114 and carries a helical gear 140. A cross shaft 141 is mounted for rotation in members 111 and 112 and carries a second helical gear 142 meshing with gear 140. Shaft 141 also carries a drum 143.

Figure 5:
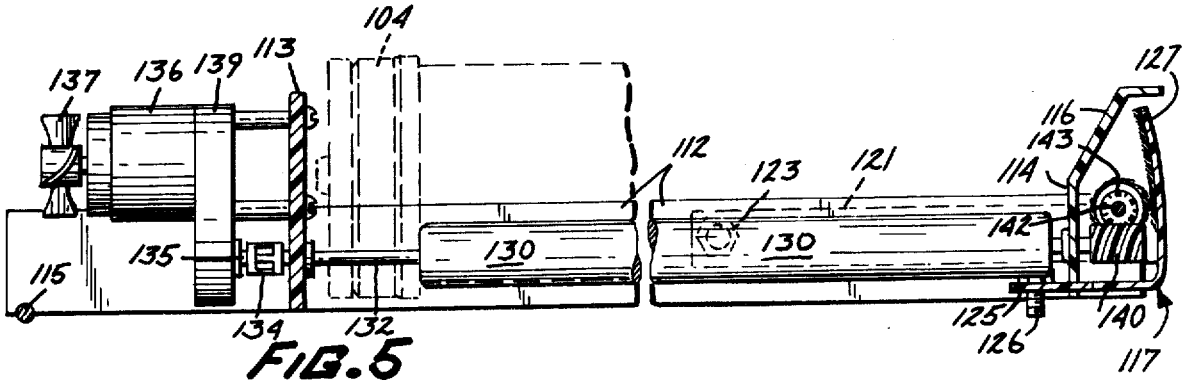
FIG. 5 is a sectional view along the line 5—5 of FIG. 4, with parts broken away for clarity of illustration.

Drum 143 and the inner surface of portion 127 of cross member 117 are covered with a material having a large coefficient of sliding friction in one direction and a small coefficient of sliding friction in the other direction. One such material is known as "FIBERTRAN" and is a product of Minnesota Mining and Manufacturing Company. The spacing of drum 143 from surface 127 is such that the fiber layers are considerably enmeshed. If drum 143 is rotated in a clockwise direction as seen in FIG. 5 the fibers engage in driving relation and frame 109 is tilted upwardly about pivot 115 as shown in FIG. 6, frame 110 pivoting at 122 and 123 while leveling screw 126 remains in sliding contact with housing bottom 105. If the direction of rotation of drum 143 is reversed the cradle moves back to its original position and the material on drum 143 continues to move relatively freely with respect to the material on the surface of member 127.

As shown in FIGS. 7 and 8, cap 104 fits frictionally over the open end of drum 100. It comprises a cylindrical body 144, a plurality of baffle plates 145, 146, 147, and 150 having the general configuration of annular sectors, an ingress member 151, an inner light baffle 152, and an outer light baffle 153. As shown in the developed view, FIG. 12, body 144 has a set of internal helical grooves 145', 146', 147', and 150', each extending through 180° around the body, the helix angle being small. The baffle plates are substantially semicircular in outline, with central semicircular cutaways to pass the nozzle 154 of member 151. A suitable adhesive secures the baffle plates to the nozzle and the grooves.

Member 151 has an enlarged head 155 with a flat circular rim 156. Baffle member 152 has an annular groove 157 to receive rim 156, and is provided with bosses 160 at which it is adhesively secured to the rim, leaving the greater part of the groove circumference free for passage of liquid between members 151 and 152 as suggested by arrow 148.

Baffle member 153 has a circular groove 161 within which the lip 162 of body 144 fits loosely. Member 153 has a hollow hub 163, by which it is sealed adhesively to nozzle 154, and is also cemented to baffle plates 145, 146, 147, and 150 at its points of contact with them, leaving the entire circumference of the groove 161 for flow of liquid past lip 162 as shown by arrow 158. It is apparent that the various members making up cap 104 are adhesively secured together in such a fashion as to result in a strong, unitary structure.

A nipple 164 is rigidly secured in cross member 113. Nozzle 106' is extended by a rigid elbow member 165. Members 164 and 165 are connected by a flexible tube 166 to allow for the slight movement between these members which accompanies tilting of the cradle. This structure is clearly shown in FIG. 13, which also shows that when a capped drum is placed on the cradle, nipple 164 extends loosely into member 154. Any liquid discharged into tray 106 passes through nozzle 106', elbow 165, tubing 166, and nozzle 164 and runs down the slanting inner surface of member 154 into the drum. The volume of the latter is much greater than the volume of any container 42, so that the former is never as much as half full: rotation of the drum accordingly agitates the liquid therein to continually bring fresh liquid into contact with the photographic material.

The function of the baffle plates is to perform a reversible pumping action which opposes egress of the liquid from the drum when it rotates in one direction, and assists egress of the liquid from the drum when it rotates in the opposite direction. As shown in FIGS. 10 and 11, the level of liquid retained in the drum when it is not rotating varies between that shown by the line 167 in FIG. 10 and that shown by the line 170 in FIG. 11. In the former case the drum is so positioned that the straight sides of the baffle plates are horizontal or vertical, and one plate acts as a dam across the end of the drum, so that liquid can rise in the drum until it reaches the level of nozzle 154 before it finds egress reversely through the normal ingress passage indicated by the arrow 148 in FIG. 8. In the latter case the drum is so positioned that the straight sides of the baffle are at 45 degrees to the vertical, and one plate acts as a low dam. Liquid above the level of line 170 in FIG. 11 may flow out along the course indicated by arrow 158 in FIG. 8. Liquid below line 170 is trapped in the drum and cannot escape.

It is apparent that if drum 100 rotates in the direction shown by the solid arrow 173 in FIGS. 10 and 11 the baffle plates act as pump buckets to move liquid out of the drum until it is empty. I have also found, however, that if the drum rotates at a reasonable speed in the other direction, shown by the broken arrow 174 in FIGS. 10 and 11, the baffle plates pump liquid back into the drum faster than it can flow out, thus retaining fluid in the drum at a level even higher than that shown by the line 170.

The orientation of the fibers on drum 143 and surface 127 is such that cradle 101 tilts upwardly at the time the baffle plates are assisting egress of liquid from the drum, and remains or returns to normal level attitude when the plates are opposing the egress of liquid.

Figure 14:
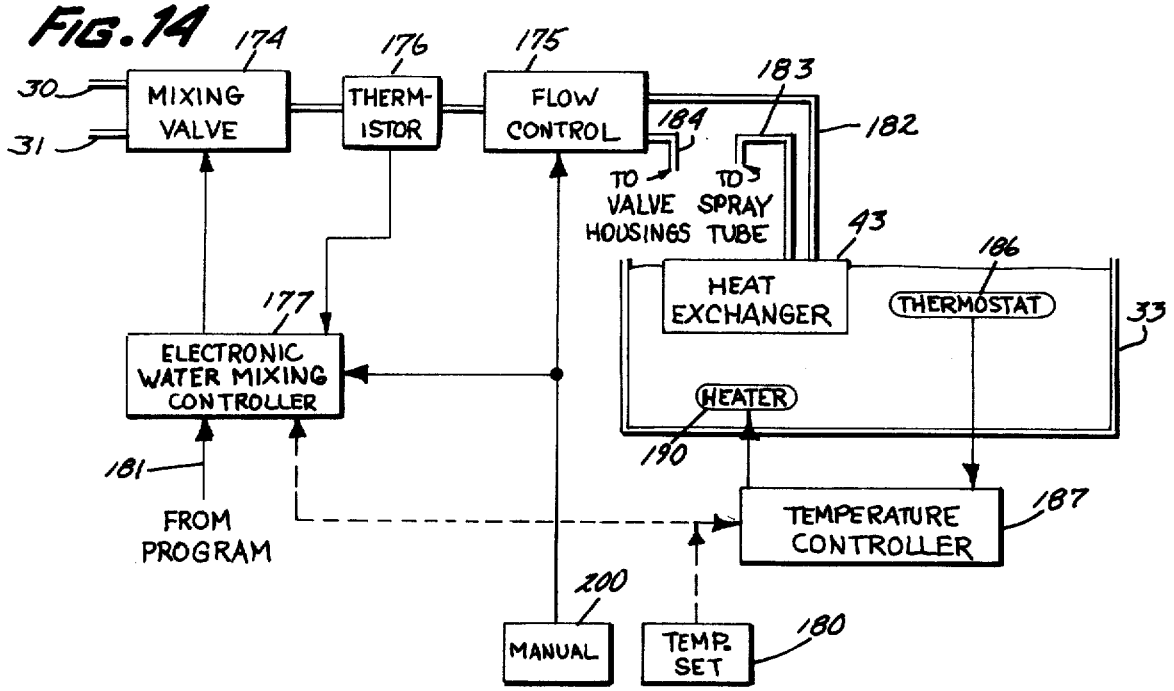
FIG. 14 is a flow diagram for water moving in my invention.

FIG. 14 is a schematic showing of the water supply to my apparatus, and the related electrical circuitry. A mixing valve 174 is connected to water connections 30 and 31, and supplies to a flow control 175 water of which the temperature is sensed by a thermistor 176. The water temperature is determined by an electronic water mixing controller 177 and may be set by a manual control 180, and liquid flow is under the control of a programmer as indicated at 181.

Flow control 175 is a two-way valve, and normally directs its output through conduit 182 to pass through heat exchanger 43 in water bath 33, and thence through a conduit 183 to spray tube 107, FIG. 2. The flow control can be actuated into a second condition, in which it directs its output through a conduit 184 to the wash water inlets 97 of the valve assemblies, by an electric signal from a manual control 200, which also is effective through controller 177 to cause liquid of the desired temperature to be supplied to the flow control from mixing valve 174. The temperature of the water in bath 33 is sensed by a thermistor 186, and a temperature controller 187 acts accordingly to energize a heater 190. Manual temperature setting control 180 acts on controller 187 as well as on controller 177.

Operation of may apparatus depends on a programming arrangement including indicators and actuating members on panel 26. Of the various known programming expedients I choose to use a drum driven electrically and having studs of various arcuate lengths embedded in rows around the cylinder. Eighteen such rows are used, and I provide a plurality of mechanically interchangeable programming drums with studs suitably positioned for performing various processing procedures. One such drum is shown at 191 in FIG. 2, received in a suitable opening 192 in panel 26. For convenience the outer end of each drum may be formed as an indicator dial divided into sections representative of the various processing steps accomplished by the drum: the inner end of the drum is provided with suitable means not shown for releasably engaging a motor shaft in driven relation thereto.

The studs on program drum 191 are intended to operate a bank of eighteen single pole, double throw miniature snap switches out of first positions and into second positions. These switches, which appear in FIG. 15, may conveniently be withdrawn radially from the drum by a lever 193 on panel 26 when drums are to be changed, to prevent accidental mechanical damage to either the studs or the switches. A panel index 194 is provided to facilitate proper initial positioning of the drum in its opening.

Various photographic procedures are most desirably performed at particular temperatures, and panel 26 includes temperature select knob 180 by means of which temperature selection of the process is made possible.

A plurality of pushbutton units are mounted on panel 26. Unit 196 is the main or POWER ON switch for the apparatus, unit 197 is for PROGRAM START, unit 200 is for MANUAL WASH, and unit 201 is for PROGRAM HOLD. There are a number of further controls on panel 26. Of these, control 203 is a last step selection switch movable between Hold and Normal positions, control 205 is a three-position drum size switch provided to allow for 2 oz., 4 oz., or 6 oz. of liquid to be supplied in the automatic operation of the apparatus, control 206 is a ten-position container select switch, and control 207 is a container drain switch, the latter two being jointly operable to effect a particular drain function. Switch 207 is in actuality a pair of single pole, single throw switches 208 and 209 mechanically interlocked, switch 208 being normally open and switch 209 being normally closed.

Figure 15:
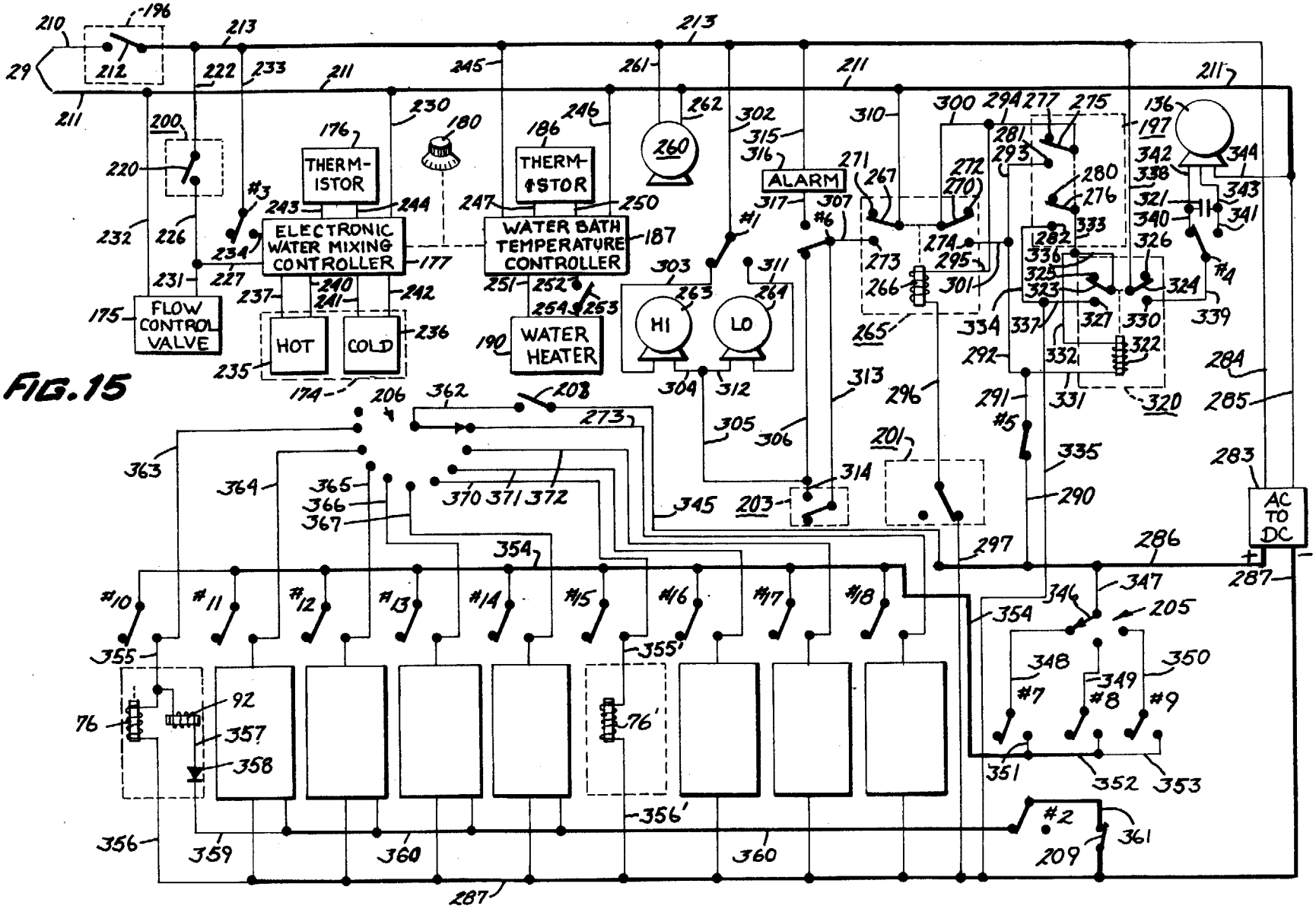
FIG. 15 is a general circuit diagram.

FIG. 15 is a partially schematic diagram showing the wiring of my apparatus. Conventional alternating voltage is supplied at connection 27 and appears on conductors 210 and 211, the latter being the neutral or normally grounded conductor and comprising the ground bus of the circuit. When a switch 212 is closed electric power is supplied to a power bus 213. Switch 212 comprises unit 196 of FIG. 2.

Unit 200 is shown in FIG. 15 to comprise a switch 220. Closure of switch 220 completes two circuits. The first circuit is from bus 213 through conductor 222, switch 220, conductors 226 and 227, controller 177, and conductor 230 to bus 211. The second circuit is from switch 220 through conductors 226 and 231, flow control 175, and conductor 232 to bus 211.

The snap switches actuated by programmer are identified in FIG. 15 by numerals preceded by the symbol #. They are numbered in the order in which they are positioned axially along the drum, and are shown in the positions which they assume when not actuated by a programmer stud. Thus WASH switch #3 is the third snap switch of the programmer-actuated assembly, and is normally open: when closed it completes a circuit from bus 213 through conductors 233 and 234, controller 177 and conductor 230 to bus 211. Mixing valve 174 has hot and cold water solenoids 235 and 236 which are energized from controller 177 through conductors 237, 240, 241, and 242. Thermistor 176 is connected to controller 177 through conductors 243 and 244.

Water bath temperature controller 187 is energized from buses 213 and 211 through conductors 245 and 246. It is connected to thermistor 186 through conductors 247 and 250, and controls the energization of water bath heater 190 through conductor 251 and through conductor 252, a float switch 253, and conductor 254. A water bath agitator motor 260 is energized through conductors 261 and 262.

Programming drum 191 is driven by either of two electric motors. High speed motor 263 drives the drum at one revolution in 12 minutes, and low speed motor 264 drives it at one revolution per hour. The circuitry for energizing these motors electrically includes SPEED switch #1, HOLD/ALARM switch #6, PROGRAM HOLD control 201, LAST STEP SELECTOR switch 203, PROGRAM START control 197, a program control relay 265, and END OF CYCLE switch #5. Relay 265 has a winding 266 which actuates a pair of movable contacts 267 and 270 out of normal engagement with first fixed contacts 271 and 272 and into engagement with second fixed contacts 273 and 274, all respectively. PROGRAM START control 197 includes a pair of movable contacts 275 and 276 which may be manually actuated out of engagement with a first pair of fixed contacts 277 and 280 and into engagement with a second pair of fixed contacts 281 and 282, all respectively. Upon removal of the manual actuation these switches return to their normal conditions. Electrical energy for relay 265 is provided by an AC to DC converter 283 energized from bus 213 and bus 211 by conductors 284 and 285: converter 283 supplies direct voltage on positive bus 286 and negative bus 287.

When PROGRAM START control 197 is actuated a circuit is completed from positive bus 286 through conductor 290, END OF CYCLE switch #5, conductors 291, 292, and 293, switch contacts 281 and 275, conductors 294 and 295, relay winding 266, conductor 296, PROGRAM HOLD control 201, and conductor 297 to negative bus 287. Relay 265 completes its own holding circuit through conductor 300, relay contacts 270 and 274, and conductor 301, and also completes a circuit from power bus 213 through conductor 302, SPEED switch #1 in its normal position, conductor 303, high speed motor 263, conductors 304, 305 and 306, HOLD/ALARM switch #6, conductor 307, relay contacts 273 and 267, and conductor 310 to ground bus 211. If SPEED switch #1 is in its actuated condition the circuit is completed through conductor 311, low speed motor 264, and conductor 312.

LAST STEP SELECTOR switch 203 is connected in parallel with HOLD/ALARM switch #6 by conductor 313 and conductors 306 and 314. When switch #6 is actuated, a circuit is completed from bus 213 through conductor 315, an alarm 316 such as a buzzer, conductor 317, switch #6, conductor 307, relay contacts 273 and 267, and conductor 310 to ground bus 211.

PROGRAM START control 197 is also included in the circuitry for energizing drum and cradle motor 136, together with a drum drive control relay 320, DRUM DUMP switch #4 and a reversing capacitor 321. Relay 320 has a winding 322 which displaces a pair of movable contacts 323 and 324 out of normal engagement with a first pair of fixed contacts 325 and 326 and into engagement with a second pair of fixed contacts 327 and 330, all respectively.

When control 197 is actuated a circuit is completed from positive bus 286 through conductor 290, END OF CYCLE switch #5, conductors 291 and 331, relay winding 322, conductors 332 and 333, switch contacts 276 and 282, and conductors 334 and 335 to negative bus 287. Relay 320 completes its holding circuit through conductor 336, contacts 323 and 327 and conductor 337.

Operation of relay 320 energizes motor 136, for forward or reverse operation, through a circuit from bus 213 through conductor 338, relay contacts 324 and 330, conductor 339, DRUM DUMP switch #4, conductor 340 or 341, reversing capacitor 321, conductors 342 and 343, the motor, and conductor 344 to ground bus 211.

The operation of the various valve solenoids is powered from AC to DC converter 283. Positive bus 286 is connected to container drain switch 208 by conductor 345, and to the movable contact 346 of drum size control switch 205 by a conductor 347. The three fixed contacts of switch 205 are connected by conductors 348, 349 and 350 to switches #7, #8 and #9, and thence by conductors 351, 352, and 353, all respectively, and a switch bus 354 to switches #10–18. The normally open contact of switch #10 is connected by conductor 355 to first terminals of poppet solenoid 76 and stopper solenoid 92 of the valve assembly for container number one. The second terminal of solenoid 76 is connected by conductor 356 to negative bus 287. The second terminal of solenoid 92 is connected through conductor 357, a diode 358, and conductor 359 to a metering bus 360. The valve assemblies for the first five containers are all equipped with both poppet and stopper solenoids, and switches #11 through #14 are consequently connected as just described. The valve assemblies for the last four containers have only poppet solenoids, and switches #15 to #18 inclusive are connected as shown in connection with switch #15. The normally open contact of switch #15 is connected by a conductor 355' to one terminal of poppet solenoid 76', the other terminal of which is connected by conductor 356' to negative bus 287.

Bus 360 is connected to the normally closed contact of valve dump switch #2, the movable contact of which is connected by conductor 361 and normally closed switch 209 to negative bus 287.

The circuit to switch 208 is extended by conductor 362 to the movable contact of container select switch 206, a ten-position switch. Nine of the fixed contacts of this switch are connected by conductors 363, 364, 366, 367, 370, 371, 372, 373 to the normally open contacts of switches #10 to #18, inclusive.

Figure 16:
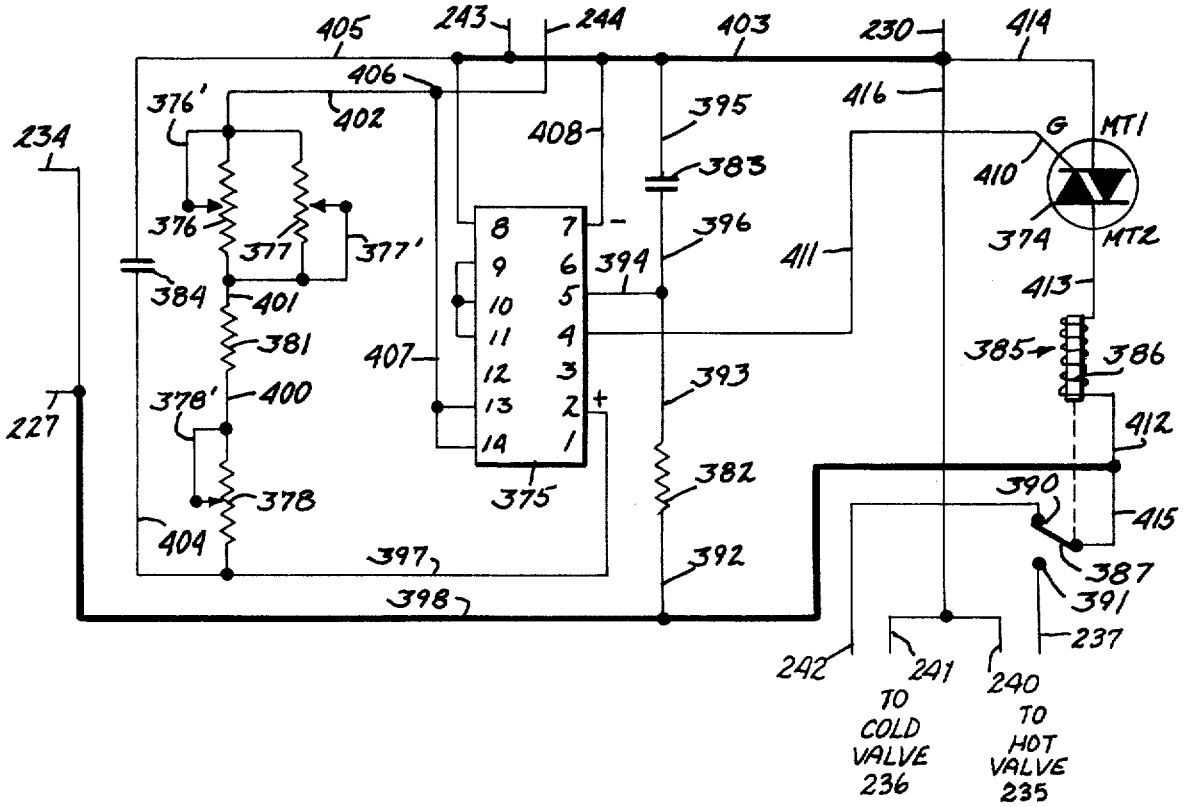
FIG. 16 is a detailed circuit diagram of a mixing valve arrangement used in my invention.

My electronic water mixing controller is shown in more detail in FIG. 16 to include a triac 374, an integrated circuit 375, a temperature setting voltage divider 376, voltage dividers 377 and 378 for trim adjustment, a pair of resistors 381 and 382, a pair of capacitors 383 and 384, and a relay 385 having a winding 386 energizable to displace a movable contact 387 out of normal engagement with a first fixed contact 390 and into engagement with a second fixed contact 391. The voltage dividers are connected as rheostats by conductors 376', 377' and 378'.

Integrated circuit 375 is a commercial product of RCA, identified by the designation CA 3059. It has power input terminals 5 and 7, the latter being ground, and supplies a direct voltage positive with respect to terminal 7 on terminal 2. The output of this circuit is supplied between terminal 4 and ground, and the input is to be applied between terminal 13 and ground. Grounding of terminal 8, and interconnection of terminals 13 and 14 and of terminals 9, 10 and 11, are accomplished because some of the capabilities of this circuit are not of use in my application of the device.

Terminal 5 is energized with power from conductor 234 or conductor 227 on a power bus 398, connected to input terminal 5 of unit 375 by conductor 392, resistor 382 and conductors 393 and 394. Bypass capacitor 383 is connected between terminal 5 and ground by conductor 395 and conductors 396 and 394. A direct current circuit may be traced from terminal 2 through conductor 397, voltage divider 378, conductor 400, resistor 381, conductor 401, the parallel connection of voltage dividers 376 and 377, and conductors 402 and 244 through thermistor 176 (FIG. 15) and conductor 243 to negative bus 403 and thence by conductor 408 to terminal 7 of unit 375. Capacitor 384 is shunted across this series circuit by conductors 404 and 405. The junction point 406 between conductors 402 and 244 is connected to terminals 13 and 14 by conductor 407. The gate 410 of triac 374 is connected to terminal 4 by conductor 411. A circuit may be traced from bus 398 through conductor 412, relay winding 386, conductor 413, triac 374, and conductor 414 to negative bus 403. Bus 398 is connected by conductor 415 to movable contact 387 of relay 385. Valve solenoid conductors 237 and 242 (FIG. 15) are connected to fixed relay contacts 390 and 391: solenoid conductors 240 and 241 are connected to ground bus 211 by conductors 416 and 230, and conductor 230 (FIG. 15) is likewise connected to negative bus 403.

The operation of the structure shown in FIG. 16 is as follows. Whenever power is supplied to bus 398 either on conductor 234 or conductor 227, one of valve solenoids 235 and 236 is energized. If the temperature sensed by thermistor 176 is less than that desired, as set by voltage divider 376, triac 374 is fired and relay 385 is energized, to cause energization of the hot water solenoid 235, so that only hot water is supplied. If the sensed temperature is above that desired, triac 374 is not fired, and relay 385 is de-energized, so that the cold water solenoid 236 is energized and only cold water is supplied. The available cold water is always colder than desired, and the available hot water is always hotter than desired, so that what takes place is a continuous alternate operation of the valves, passing small charges of water of the two different temperatures. These charges of water pass into heat exchanger 43 where a time integration or averaging of temperature occurs, so that the mixed water assumes the desired temperature value. Since the heat exchanger is immersed in water bath 33 having the same called for temperature, and since the volume of the heat exchanger is greater than the amount of liquid called for at any one time, an adequate supply of water at the desired temperature is thus assured.

For use my machine is installed in a darkroom, and connections are made for electric power, hot and cold water, and drainage. A clean, empty container 42 is sealingly secured into each valve assembly 47 and loosely covered. The water bath is filled to the desired level, thus closing float switch 253, and heat exchanger 43 is full of water.

POWER ON control 196 may now be actuated, closing switch 212. This energizes AC to DC converter 283, water bath agitator motor 260 cradle motor 136, and water temperature control 187, which in turn energizes heater 190 to bring the water bath temperature, as sensed by thermistor 186, to that desired and set by controller 180.

The operator considers the first processing task to be accomplished, selects the appropriate programmer drum 191, depresses lever 193, inserts the drum in aperture 194 and brings its initial or start indication in alignment with index 194, so that the drum is in driven relation to motors 263 and 264. He then mixes the required solutions, if necessary, and fills the scheduled containers with the scheduled amounts of developers, bleaches, fixers, stabilizers, and so forth according to the task in hand. A sufficient number of containers 42 are supplied for processes requiring up to nine different liquids. The operator selects a processing drum 100 appropriately sized for the first task and sets control 205 accordingly to call for a small, medium, or large amount of processing liquid, if metering dispensing is to be employed. If it has been some time since hot water has been drawn from connection 30, so that its temperature has dropped perhaps to ambient, the operator may actuate WASH control 200 and hold it for a moment: as shown in FIG. 15 this provides electrical signals to flow control 175 and electronic water mixing controller 177. As a result water flows from mixing valve 174 to flow control 175 and thence by conduit 184 to the inlet conduits 97 of valve assemblies 51. The water leaves the valve assemblies by boot apertures 87, drops to tray 106 and flows through nozzle 106' and nipple 164, falling to the bottom 105 of housing 102 and being disposed of through drain 32. Initially, thermistor 176 senses a temperature below that called for by selector 180, triac 374 is fired and relay 386 is energized to cause the water to be drawn through the hot water valve 235. This continues until the "hot" water is truly hot, when alternate operation of the hot and cold water solenoid beings, as described above. The operator may now release control 200, and flow of water ceases. This process has incidentally washed any traces of residual chemicals from the valves, the tray, and the nozzle, so that contamination is avoided.

While he is waiting for heater 190 to bring the water in bath 33, and hence the liquids in containers 42 and the water in heat exchanger 43, to the temperature called for by selector 180, the operator may turn out the darkroom lights and load the first photographic material to be processed into the selected processing drum. When this is done and the cap has been installed on the drum, the darkroom illumination may be restored, and door 24 may be opened and the drum inserted, lying on its side on rollers 130 and 131 with the rim 128 of the cap in engagement with the ends of the rollers, and with nipple 164 received within central aperture of nozzle 154.

By way of example, let it be supposed that the operator has loaded a drum with a material suitable for processing in C41 chemistry, positioned on suitable spacing reels with no surfaces in contact. He will of course have selected the "C41" programming drum. The container identified as #1 will have been filed with developer, #2 with bleach, #3 with fixer, and #4 with stabilizer, the compositions of these liquids for use with C41 film being of course well known. It having been determined that this processing task requires 23 minutes, the slow speed motor must be used to drive the programmer, although the cycle will require only a partial drum revolution. This means that snap switch #1 must be energized for the entire cycle.

For this processing task it is not necessary to supply carefully metered small quantities of liquids to the processing drum. A quart of developer, bleach, fixer, or stabilizer is sufficient to process 10 reels of film, and pint will process 5 reels. The operator simply puts the amount of liquid into the containers which is called for by the task he is undertaking, and the containers are automatically emptied at appropriate times into the processing drum. This means that at no time do stopper solenoids 92 require energization, and to ensure this snap switch #2, like switch #1, is actuated for the entire cycle. All of switches #7, #8, and #9 are also maintained closed, to eliminate the requirement that switch 205 be present in any particular position.

For the foregoing reasons the studs in positions 1 and 2 on this programming drum, which must continue throughout the full cycle, are actually rings for convenience in manufacture, although their portions after the full 23 minutes of the cycle are not functionally significant. The studs in positions 3 to 13 are located and sized in accordance with the processing steps being performed, beginning at a time $T_o$ where the operator actuates PROGRAM START control 197. No studs are needed in positions 14 through 18 for this processing task. Upon insertion the programming drum is rotated to a position representive of the state at the time $T_o$: switches #1, #2, #7, #8, and #9 are actuated, all others being in their normal conditions.

Figure 17:
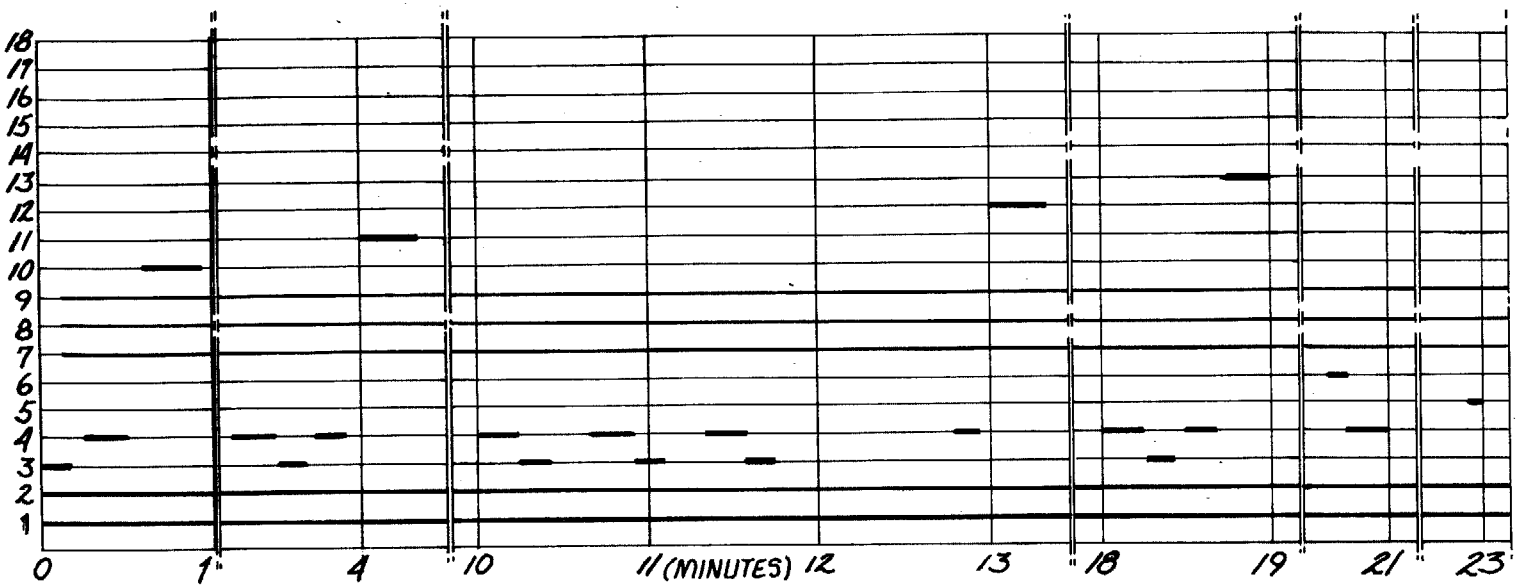
FIGS. 17 and 18 are schematic showings of typical programs used in the practice of my invention.

PROGRAM START control 197 may now be actuated. This energizes low speed motor 264 through actuator snap switch #1, and the programming drum begins to turn. For a schematic showing of the program followed in processing C41 film, refer to FIG. 17.

Switch #3 is actuated immediately, energizing mixing control 177 to open one of valves 235 and 236 depending on the relation of the temperature sensed at thermistor 176 to that selected by control 180. The water passes through flow control 175, presently unactuated, and replaces water stored in heat exchanger 43 at the selected temperature. The water passes through the spray tube, then falls to tray 106 and flows through nozzle 106′ into drum 100 where it wets the film to be processed. After ten seconds the water supply is cut off by a switch #3: drum rotation continues for another five seconds to be sure that all the film in the drum is wet as well as preheated to processing temperature. During this interval the water is retained in the drum by the action of the baffle plates.

The processing drum is now drained by actuation of switch #4. This acts in cooperation with capacitor 321 to reverse the direction of motor 136, and cradle 109 is actuated into its FIG. 6 position, tipping the drum so that the vanes can allow all of the liquid to pass therefrom. This is accomplished by the interaction between the anisotropic friction materials on drum 143 and cylindrical surface 127, because of which the drum climbs up the surface to its top and remains there, the drum continuing to turn to prevent the cradle from descending.

After 15 seconds switch #4 restores motor 136 to its forward direction, the cradle returns to level, and the drum is ready to receive the first processing liquid, which is developer in container #1. Switch #10 is actuated, and completes a circuit from positive bus 286 through conductor 347, switch 346, one of conductors 348, 349 and 350, one of switches #7, #8 and #9 (all of which are closed), one of conductors 351, 352 and 353, bus 354, switch #10, conductor 355, solenoid 76, and conductor 356 to negative bus 287. This energizes the valve solenoid 76 for container #1. Liquid flows from the container through metering chamber 95 and out through boot 86, solenoid 92 being at this time unenergized. Switch #10 remains actuated for 20 seconds, during which interval the entire contents of container #1 may be drained to tray 106 and thence through nozzle 106′ to processing drum 100, which continues to rotate after switch #10 is deactuated. The rotation continues for 3 minutes and 15 seconds, when switches #4 and #3 cause the processing drum to be drained, releveled, and supplied with wash water, again drained, and again releveled.

Switch #11 is now actuated to dump the contents of container #2, a bleach, into the processing drum. The bleach is allowed to act on the film for 5 minutes and 40 seconds. Then switches #4 and #3 dump the spent bleach and cause three successive rinses, two of 15 seconds and one of 60 seconds, each in fresh water.

Switch #12 is now actuated to dump the contents of container #3, a fixer, into the processing drum. The fixer is allowed to act on the film for 4 minutes and 40 seconds. Then switches #4 and #3 dump the spent fix and cause a single rinse in clear water.

Switch #13 is now actuated to dump the contents of container #4, a stabilizer, into the processing drum. After the stabilizer has been allowed to act on the film for 1 minute and 40 seconds, switch #6 is actuated. This stops the operation of the programmer motor and causes alarm 316 to sound. Rotation of the processing drum is not interrupted, nor is the stabilizer liquid drained therefrom at this time.

The purpose of alarm 316 is to call the attention of the operator to the face that the processing is complete. After the film was inserted into the processing drum the normal lighting in the darkroom was restored, and the operator was free to do other tasks, and even to leave the darkroom. However, it would not do to allow the program to continue to completion in the operator's absence, as the drum would be emptied and the film would begin to dry in the drum, which is undesirable.

With the operator in attendance, sounding of the alarm results in his actuating control 203, thus shunting switch #6, until the program releases switch #6, whereupon alarm 316 ceases and the program goes on to completion. The processing drum is reversed, drained, and releveled, and switch #5 is actuated to end the cycle and stop the processing drum as well as the programming drum. The operator now opens the processing drum, removes the film, and hangs it to dry.

If for any reason the operator wishes to extend any portion of the program he may actuate PROGRAM HOLD control 201. This de-energizes relay 265, thus disabling high speed motor 263 and low speed motor 264, although relay 320 is not de-energized and motor 136 continues in operation. When the additional interval desired by the operator has run, he operates PROGRAM START control 197 to cause the program to recommence where it was interrupted.

If the succeeding processing task is again to develop C41 film, the operator needs only to advance drum 191 manually through the remaining unused portion of its rotation, until its start graduation is in line with index 194.

Figure 18:
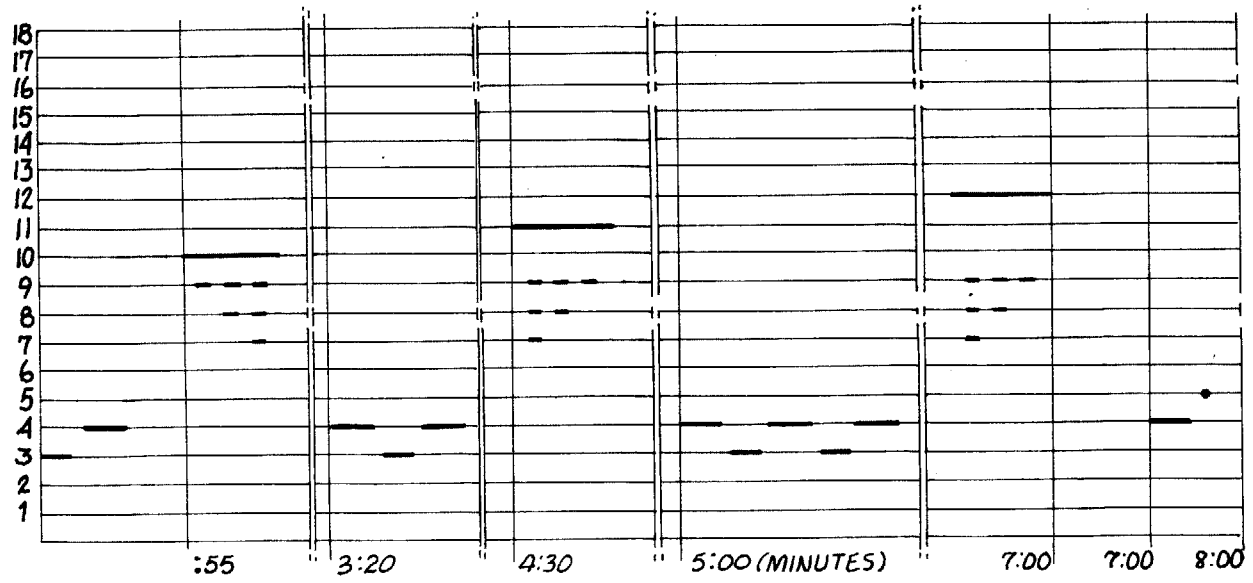

FIG. 18 is presented to show an alternative processing program in which liquid is dispensed by metering. This program requires 8 minutes, and hence the high speed motor is preferably used. Switch #1 is accordingly allowed to remain in its normal position for the entire processing cycle. Meter dispensing of liquids requires that the stopper solenoid 92 for each valve so used must be energizable, and for this purpose switch #2 must also remain in its normal position. Thus no studs appear on the processing drum in the #1 and #2 positions.

The volume dispensed by metering chamber 95 is two fluid ounces—enough to treat a small print in a small processing drum. Provision is made to dispense 1, 2, or 3 chambersfull of liquid according as switch 205 is set in clockwise, center, or counterclockwise position thus allowing adequate amounts of liquid to be dispensed for processing larger prints in larger processing drums. This is because position 7 of the processing drum has single studs, position 8 has pairs of studs, and position 9 has trio of studs, as is shown in FIG. 18. For illustrative purposes it will be assumed that switch 205 is in its counterclockwise position.

Upon starting the program an initial wetting of the material in the revolving drum occurs as before. After the drum has been drained and releveled, switch 10 is actuated. This is a preparatory step: it does not affect the valve of container 1 because the circuit to positive bus 286 is open at switches #7, #8 and #9. However when switch #9 is actuated the circuits for both solenoid 76 and solenoid 92 of valve number 1 are energized. The metering chamber is stoppered, and liquid flows to fill the chamber from the container: switch number 9 remains operated for a long enough interval to ensure this. When switch number 9 is again open, the poppet valve closes and the stopper opens, preventing further flow of liquid from the container into the chamber and allowing the contents of the chamber to discharge into the processing drum. After an interval sufficiently long to allow the chamber to drain, switch number 9 is again actuated at two further spaced intervals, allowing two further metered volumes of liquid to be discharged into the processing drum. Processing is now allowed to continue for the necessary interval, after which the draining, washing, and liquid dispensing functions are continued as called for by the program drum.

One of the advantages of my processing machine is the low likelihood of chemical contamination of the various working solutions, so that defects in the work product are avoided. Each admission of water for washing the photographic material between the process stages also rinses the entire liquid conducting path, so that no residual chemical can remain anywhere to be carried into a succeeding process. The manual wash facility even allows the valve assemblies to be rinsed below the poppet valves whenever desired.

I also provide for draining the liquid remaining in any container at any time, as at the end of the day, for rinsing any container, and even for removing any container for washing or replacement, without disturbing the system as a whole, as will now be explained.

At the end of a work period the operator uses switches 206 and 208, see FIG. 15, to drain liquid remaining in any containers. For example, switch 206 is turned to position 1 and switch 208 is closed, a circuit may be traced from positive bus 286 through conductor 345, switch 208, conductor 362, switch 206, conductors 363 and 355, solenoid 76 of valve assembly #1, and conductor 356 to negative bus 287. The valve opens and any residual liquid in the container is drained therefrom. The container may then be rinsed by water poured in at the top, and again drained, and then covered. The same procedure may be followed with other containers as may be needed.

After continued use it may be that one or more of the containers need to be more thoroughly cleaned than can be accomplished by rinsing. When this appears desirable, the container is drained and rinsed as just described, and then simply unscrewed from its socket. As its lower end becomes free from the socket bath water will pass upward into it, but it will also drain out again as the container is lifted out of the bath. Because of the previous rinsing, no significant contamination of the bath water occurs. After such chemical or physical cleaning as is called for has been accomplished, the container is returned to the bath and replaced in its socket: during this process it again at least partially fills with bath water. By use of switches 206 and 208 this water is drained out, and the container is again rinsed, after which it is ready to be filled and used in programmed processing. Any loss of liquid from the bath is replaced from time to time as is necessary.

From the foregoing it will be evident that I have devised an improved automatic photographic processing machine having structural features which result in operation which is economical in time and chemical consumption, is fully automatic in a lighted environment after the photographic material to be processed has been loaded into processing drums, is notably free of chemical contamination, and can readily be programmed to process any silver halide photographic material whose processing characteristics are known. The structure by which these various advantages are obtained is moreover relatively modest in cost, and therefore is available to a larger number of professional photographers than would be the case with more expensive equipment.

Numerous advantages and features of novelty of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principal of the invention, to the full extent indicated by the broad general meaning of the terms in which the appended claims are expressed.

I claim:

1. In automatic photographic developing apparatus, in combination:

a cradle tiltable about a first axis;

a cylindrical developing drum;

means in said cradle, including a drive roller, for supporting said drum on its side and causing rotation of said drum about a second axis orthogonal with said first axis;

reversible drive means connected to said driven roller for causing rotation thereof in first and second opposite senses;

and cradle tilting means operatively connected to said drive means and operable to tilt said cradle only when driven in a first sense.

2. Apparatus according to claim 1 in which said tilting means includes a first, cylindrical drum element driven by said driving roller and a further element having a concave surface centered about said first axis for tangential engagement by the surface of said drum element, the surfaces of said elements being such as to provide a high coefficient of friction therebetween when said drive roller rotates in a first sense, and a low coefficient of friction when said drive roller rotates in the opposite sense.

3. In automatic photographic developing apparatus having a programmer, a developing drum, and at least one container of liquid to be delivered to the drum, a valve assembly comprising:

a. a housing;

b. a metering chamber within said housing sized to contain a desired volume of said liquid;

c. first normally closed valve means operable rapidly to admit liquid from said container to said chamber;

d. second, normally open valve means operable to prevent flow of liquid from said chamber; and e. actuating means connecting said valve means in controlled relation to said programmer;

said housing including an upper central passage for liquid ingress and a lower lateral passage for liquid egress, said first and second valve means being positioned to normally occlude said upper passage and open said lower passage respectively, and said second valve means including a flexible boot secured to said housing at the location of said lower passage and having an aperture aligned with said lower passage, a stopper unitary with the wall of said boot opposite said aperture, a solenoid bracket carried by said housing, and solenoid means on said bracket for acting on said boot outside said stopper to force said stopper into occluding engagement with said aperture.

* * * * *